US006779818B2

(12) United States Patent
Senn

(10) Patent No.: US 6,779,818 B2
(45) Date of Patent: Aug. 24, 2004

(54) DOOR CONTROL MECHANISM

(75) Inventor: Brian A. Senn, South Milwaukee, WI (US)

(73) Assignee: Powerbrace Corporation, Kenosha, WI (US)

( * ) Notice: Subject to any disclaimer, the term of this patent is extended or adjusted under 35 U.S.C. 154(b) by 0 days.

(21) Appl. No.: 10/180,363

(22) Filed: Jun. 26, 2002

(65) Prior Publication Data

US 2004/0000793 A1 Jan. 1, 2004

(51) Int. Cl.[7] ..... E05C 9/00

(52) U.S. Cl. ..... 292/11; 292/218; 292/241; 292/DIG. 32

(58) Field of Search ..... 292/11, 95, 291, 292/218, 241, DIG. 32, DIG. 47

(56) References Cited

U.S. PATENT DOCUMENTS

| | | | | | |
|---|---|---|---|---|---|
| 1,692,295 | A | * | 11/1928 | Gererd | 292/242 |
| 2,861,830 | A | | 11/1958 | Bennett | |
| 3,099,473 | A | * | 7/1963 | Pastva et al. | 292/240 |
| 3,484,127 | A | | 12/1969 | Pastva | |
| 3,572,794 | A | | 3/1971 | Pastva | |
| 3,652,112 | A | * | 3/1972 | Panelli | 292/210 |
| 3,740,978 | A | * | 6/1973 | Smith et al. | 70/100 |
| 3,801,146 | A | * | 4/1974 | Donath et al. | 292/218 |
| 3,806,173 | A | | 4/1974 | Sweda | |
| 3,893,722 | A | * | 7/1975 | Galbreath et al. | 292/100 |
| 4,029,349 | A | | 6/1977 | Sweda et al. | |
| 4,068,409 | A | | 1/1978 | White | |
| 4,232,891 | A | | 11/1980 | Ringe | 292/218 |
| 4,235,463 | A | | 11/1980 | Benevenuta | 292/218 |
| 4,483,557 | A | | 11/1984 | Pastva | 292/218 |
| 4,505,501 | A | * | 3/1985 | Fuchs et al. | 292/62 |
| 4,601,501 | A | | 7/1986 | Pastva | 292/218 |
| 4,632,595 | A | * | 12/1986 | Schaeff | 403/330 |
| 4,844,523 | A | | 7/1989 | Pastva | 292/218 |
| 4,869,023 | A | | 9/1989 | Bakula et al. | 49/398 |
| 4,925,041 | A | * | 5/1990 | Pehr | 215/216 |
| 4,941,703 | A | * | 7/1990 | Curry | 296/37.6 |
| 5,063,764 | A | * | 11/1991 | Amis et al. | 70/100 |
| D353,533 | S | | 12/1994 | Lee | D8/343 |
| 5,718,467 | A | * | 2/1998 | Weinerman et al. | 292/218 |
| 6,116,665 | A | * | 9/2000 | Subliskey | 292/241 |
| 6,502,868 | B1 | * | 1/2003 | Laspa et al. | 292/26 |

OTHER PUBLICATIONS

Powerbrace Corporation, Drawing No. 4257, dated May 03, 1999.

* cited by examiner

*Primary Examiner*—Robert J. Sandy
*Assistant Examiner*—Carlos Lugo
(74) *Attorney, Agent, or Firm*—John W. Harbst

(57) ABSTRACT

A door control mechanism including a latching member for aligning and latching a pivotal door on a cargo container. The latching member includes a single tine or locking tongue formed integral with and extending from a head portion of the latching member. A distal end of the locking tongue has a tapered configuration to promote introduction of the tine into latching relation relative to a keeper member.

14 Claims, 4 Drawing Sheets

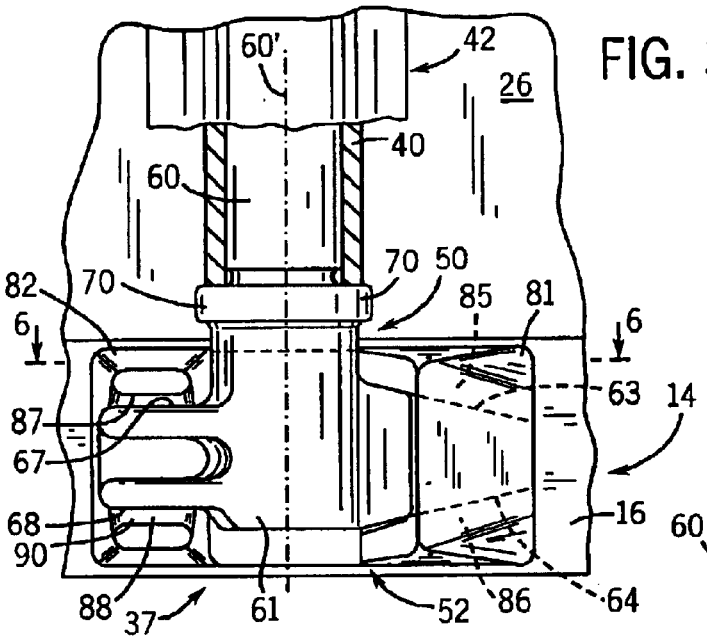
FIG. 3
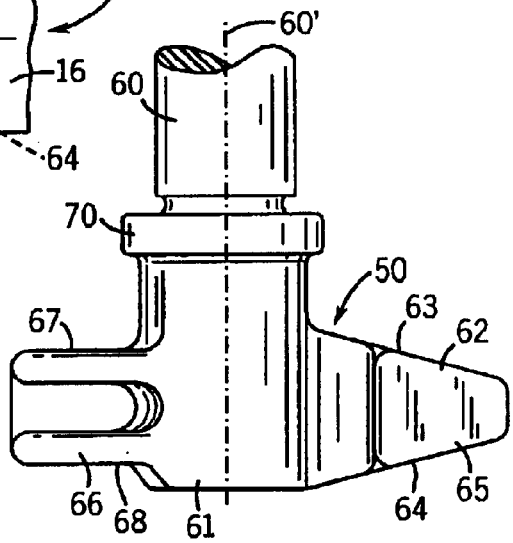
FIG. 4
FIG. 5
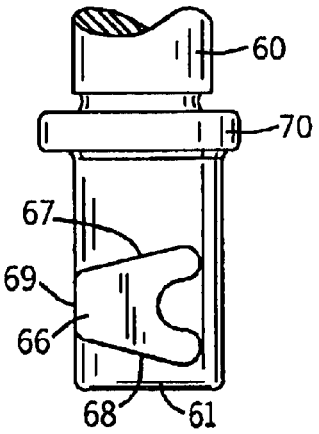
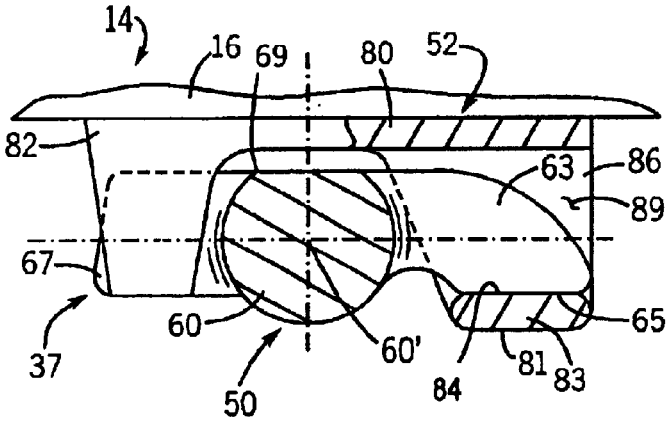
FIG. 6

FIG. 7
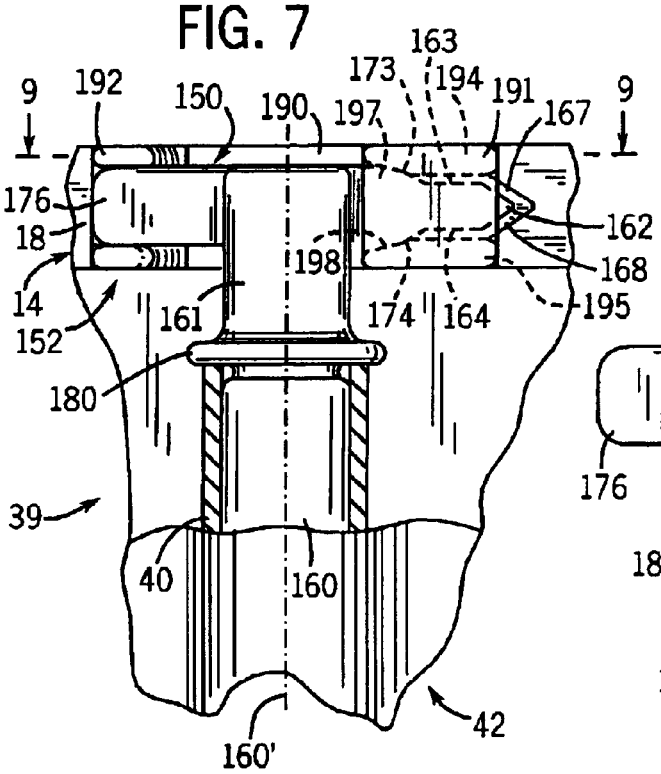
FIG. 8
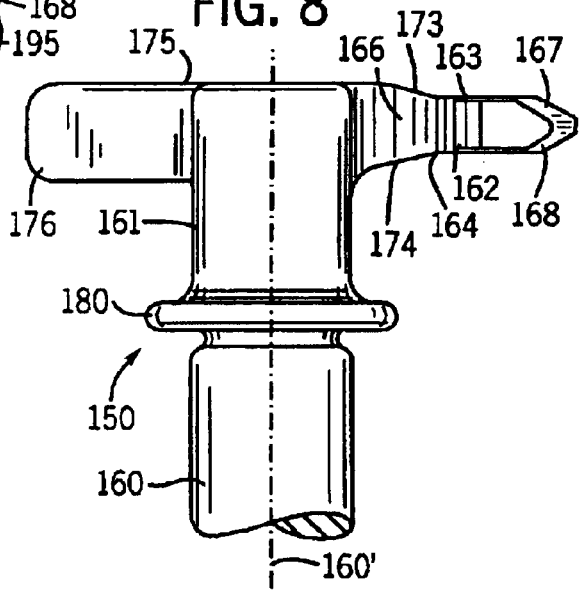
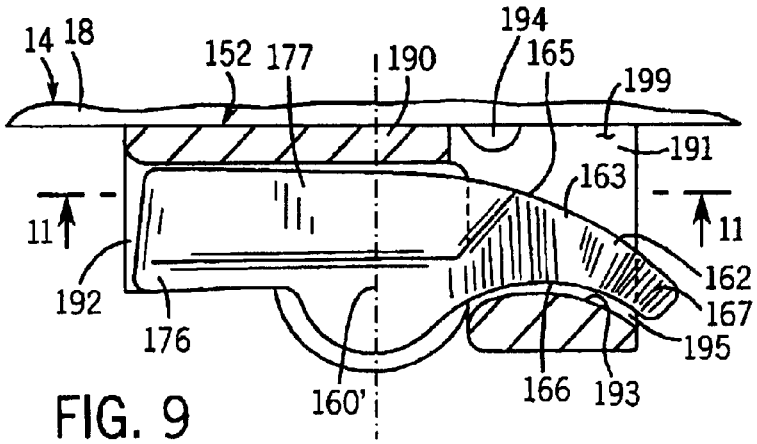
FIG. 9
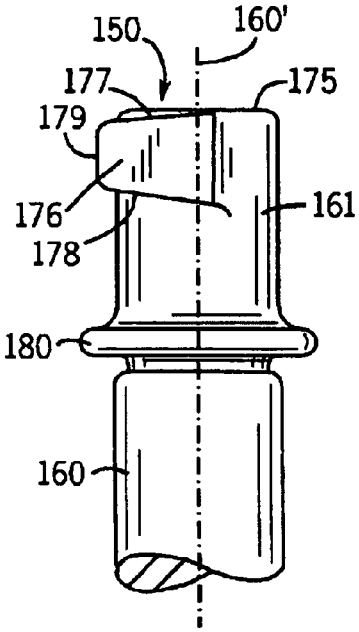
FIG. 10
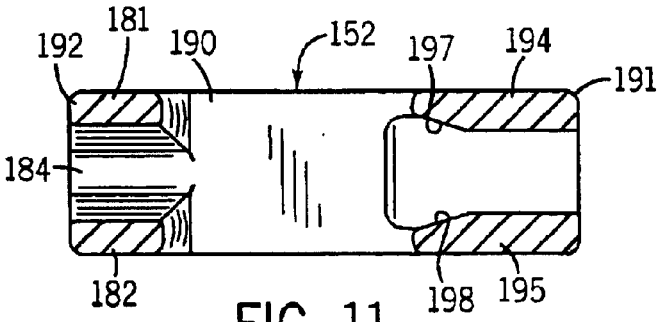
FIG. 11

DOOR CONTROL MECHANISM

FIELD OF THE INVENTION

The present invention generally relates to a door control mechanism including latching members and keeper members for releasably latching and maintaining a pivoted door in a closed position and, more particularly, for effecting alignment of relatively large pivoted doors of truck trailers and/or large cargo containers relative their associated door frames and the like.

BACKGROUND OF THE INVENTION

Trucks, trailer bodies and large cargo or shipping containers have enclosed bodies which are typically provided with a generally rectangular door frame at one end of the container or the like. A pair of doors usually define one end wall of the container. Typically, the doors are adapted to pivotally swing within the plane of the door frame and are constructed as large as possible to facilitate loading and unloading of the container. Various door control devices are used to latch and maintain the doors in a closed position and to reduce or eliminate transverse distortion, or racking, in the trailer bodies and cargo containers.

To maximize internal cargo space, and since outside measurements of cargo containers are substantially regulated by Industry standards, the container is typically fabricated from relatively thin materials. The container door frame includes an upper transverse header and a lower transverse sill which are welded or otherwise joined by vertical sideframe members.

As the size of truck trailers and cargo containers has increased, a combination of changes have been made in the configurations of trailers and containers, including greater trailer length and larger door openings. Enlargement of the door openings has been achieved by narrowing the associated door frame members housing or framing the doors.

Because of the relatively large size and weakness of the frame members, under certain circumstances, a racking effect is often applied to the container and, thus, the door frame is subject to considerable distortion. Such racking effect causes the header to move transversely and generally parallel relative to the lower sill, thus, tending to distort the door frame members from a generally rectangular configuration into a trapezoidal configuration. Such "racking" typically occurs when the cargo container is not standing level, i.e., the rear wheels of the vehicle are on different levels. Such racking action also tends to occur from twisting or jostling of the container during travel, particularly at high speeds.

It is common practice to utilize the doors, when closed, to add stiffness to the frame of the cargo container. A common and well known device for holding the doors in their closed position is disclosed in U.S. Pat. No. 4,869,023 to R. J. Bakula, et al. and includes a rotary bar locking mechanism associated with each door on the cargo container. Such a locking mechanism includes an elongated lock rod extending generally the height of the door and having a latching member at each end thereof arranged for engagement with a keeper member on the door frame.

Besides having to narrow the frame members, a related problem with the ever increasing need to enlarge the size of the trailers and doors is the reduction in surface area on the frame members available for attachment of the keeper members. This, in turn, has diminished the vertical height or width available for the design of cams on the latching members and keeper members and has thereby limited the amount of door misalignment that is correctable by the cam designs on the latching members and keeper members.

At least at one end, the door latching member disclosed in the '023 device includes an elongated wedge shaped locking tongue. That is, the distal end of the locking tongue on one door latching member extends a further radial distance from the axis of rotation of the lock rod than does the distal end of the locking tongue on other door latching member. Accordingly, the longer locking tongue engages its respective keeper and, thus, draws or aligns the respective door until the locking tongue on the other door latching member engages with its respective keeper.

During actual use or practice, however, it has been discovered the racking of the cargo container can be such that the distal end of the longer locking tongue is such that it abuts with its respective keeper. Alternatively, the longer locking tongue engages with its respective keeper but, because of its relative narrow width, has limited gathering capability. Thus, in some instances, the latching member having the longer tongue tends to inhibit and cause problems with the other latching member engaging with its respective keeper thereby adding difficulty in closing he doors of the cargo container. Moreover, the cam design on some latching members are such that they facilitate alignment of the respective door only in a single direction. Thus, when the cargo container is racked in a particular direction, the cam design can offer only minimum or little assistance in correcting door misalignment problems relative to the door frame.

Thus, there is a continuing need and desire for a door control mechanism having a latching member designed to facilitate alignment of a cargo container door and which is configured to facilitate its introduction into locking engagement with the respective keeper member of the control mechanism.

SUMMARY OF THE INVENTION

In view of the above, and in accordance with a first aspect of the present invention, there is provided an improved latching member for a door control mechanism adapted for use with a pivotal door on a cargo container. The latching member includes a single tine or locking tongue preferably formed integral with and extending from a head portion of the latching member. In a preferred form, the latching member tine or tongue has converging curved surfaces extending from the head portion toward a distal end of the locking tine.

A salient feature of the present invention relates to designing the distal end of the locking tongue or tine with a taper whereby promoting introduction of the tine into latching relation relative to a keeper member. In one form, the tapered configuration involves a slanting surface extending at an acute angle ranging between about 25° and about 60° for a distance measuring between about 0.093 inches and about 0.500 inches from an apex of the tine toward the head portion. In another form, the tapering configuration is provided at the distal end of the tine by providing two generally planar slanted and converging surfaces angling toward the apex of the tine. In this form, each slanted surface is disposed at a generally equal angle relative to a generally horizontal plane while each slanted surface extends inwardly toward the head portion of the latching member for a distance of about 0.200 inches.

Another salient feature relates to configuring the latching member tine with diverging slanted surfaces extending from the upper and lower surfaces of the locking tongue or tine and extending toward said head portion. Configuring the locking tongue with diverging slanted surfaces in the area where the tongue and head portion are conjoined increases its cross sectional area, thus, adding strength and rigidity to the elongated tine or locking tongue.

Another aspect of the present invention relates to a door control mechanism which facilitates alignment of a cargo container door relative to the door frame and latching thereof in a closed position. The door to be aligned and latched is typically hinged to a frame including a transverse header and sill which are joined by vertical side frame members.

According to this aspect of the invention, the door control mechanism includes a rotatable operating shaft adapted to be mounted parallel to an outer face of the cargo door about a substantially fixed vertical axis spaced from a hinged edge of the door. First and second latching members are arranged at opposite ends of the shaft to turn in timed unison therewith. Each latching member includes a locking tongue extending in a first lateral direction from a head portion of the latching member. When secured to opposed ends of the shaft, it is common to configure the latching members such that one latching member has significantly greater gather than the other latching member.

First and second keeper members, adapted for securement to the header and sill of the door frame, are configured to cooperate with the latching members in a manner promoting alignment and positioning of the door as a function of operation of the mechanism. Each keeper member has a base with a tapered surface leading toward a latch locking zone of the keeper member. The keeper member adapted to be secured to the sill is preferably configured such that the tapered surface thereon is specifically designed to cooperate with that latching member having the greater gather whereby facilitating alignment of the door relative to the door frame.

According to this aspect of the invention, both latching members are configured and secured to the shaft such that the distal end of the tine on each locking member is introduced into the latch locking zone of the respective keeper members substantially simultaneously thereby offering an improved gathering range when the door control mechanism is operated to position the latching members in locking relation relative to their respective keeper members. In one form, the latching member having greater gathering capability is preferably disposed to cooperate with that keeper member adapted to be secured to the sill of the door frame. In a most preferred form, the latching member arranged toward an upper end of the operating shaft is configured in accordance with the first aspect of this invention mentioned and described above.

A primary object of this invention is to provide a door control mechanism latching member having a locking tongue or tine which is configured to imparting aligning movements to a misaligned cargo container door but yet which is configured to facilitate introduction of a distal end of the tine into operable association with an associated keeper member.

Another object of this invention is to provide new and novel design changes to an elongated tongue or tine of a door latching member whereby facilitating its operation in combination with a respective keeper while maintaining sufficient strength and rigidity for the latching member to promote alignment of misaligned cargo container doors.

Still another object of this invention is to provide a door control mechanism having an operating shaft with latching member at opposed ends thereof and which are adapted to combine with keeper members arranged on the door frame, with the locking tongues or tines on the latching members being configured and secured to the operating shaft such that the distal end of the tine on each locking member is introduced into a latch locking zone of the respective keeper members substantially simultaneously thereby offering an improved gathering range when said mechanism is operated to position said latching members in locking relation relative to their respective keeper members.

These and other objects, aims, and advantages of this invention will become more readily apparent from the following detailed description, the drawings, and the appended claims.

BRIEF DESCRIPTION OF THE DRAWINGS

FIG. 3 is an enlarged elevational view of a lower aligning and latching mechanism forming part of the door control mechanism of the present invention;

FIG. 4 is an elevational view of a latching member forming part of the latching and aligning mechanism illustrated in FIG. 3;

FIG. 5 is a side elevational view of the latching member illustrated in FIG. 4;

FIG. 6 is a sectional view taken along line 6—6 of FIG. 3

FIG. 7 is an enlarged elevational view of an upper aligning and latching mechanism forming part of the door control mechanism of the present invention;

FIG. 8 is an elevational view of a latching member forming part of the latching and aligning mechanism illustrated in FIG. 7;

FIG. 9 is a top plan view of the latching member illustrated in FIG. 8 illustrated in an engaged relationship with a keeper member;

FIG. 10 is a side elevational view of the latching member illustrated in FIG. 8;

FIG. 11 is a sectional view taken along line 11—11 of FIG. 9 with the latching member removed to show details of the keeper member.

DETAILED DESCRIPTION OF THE INVENTION

Figure 2:
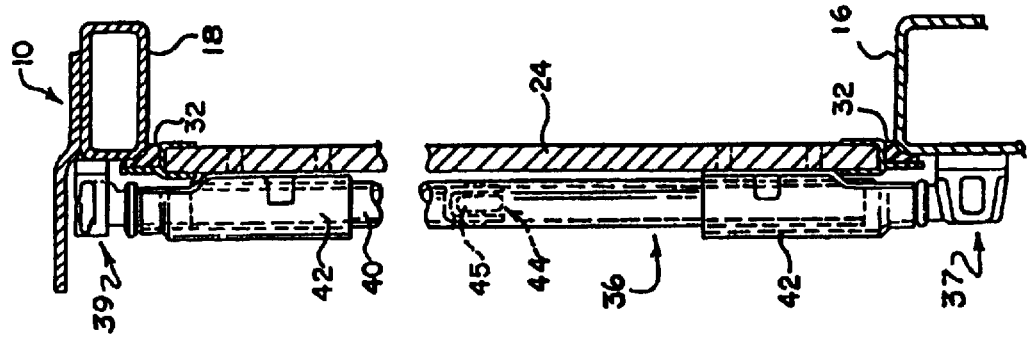
FIG. 2 is a partial sectional view taken along line 2—2 of FIG. 1.

This invention is susceptible of embodiment in multiple forms. There is shown in the drawings and will hereinafter be described a preferred embodiment of the invention, with the understanding the present disclosure is to be considered an exemplification of the invention which is not intended to limit the invention to the specific embodiment illustrated and described.

Figure 1:
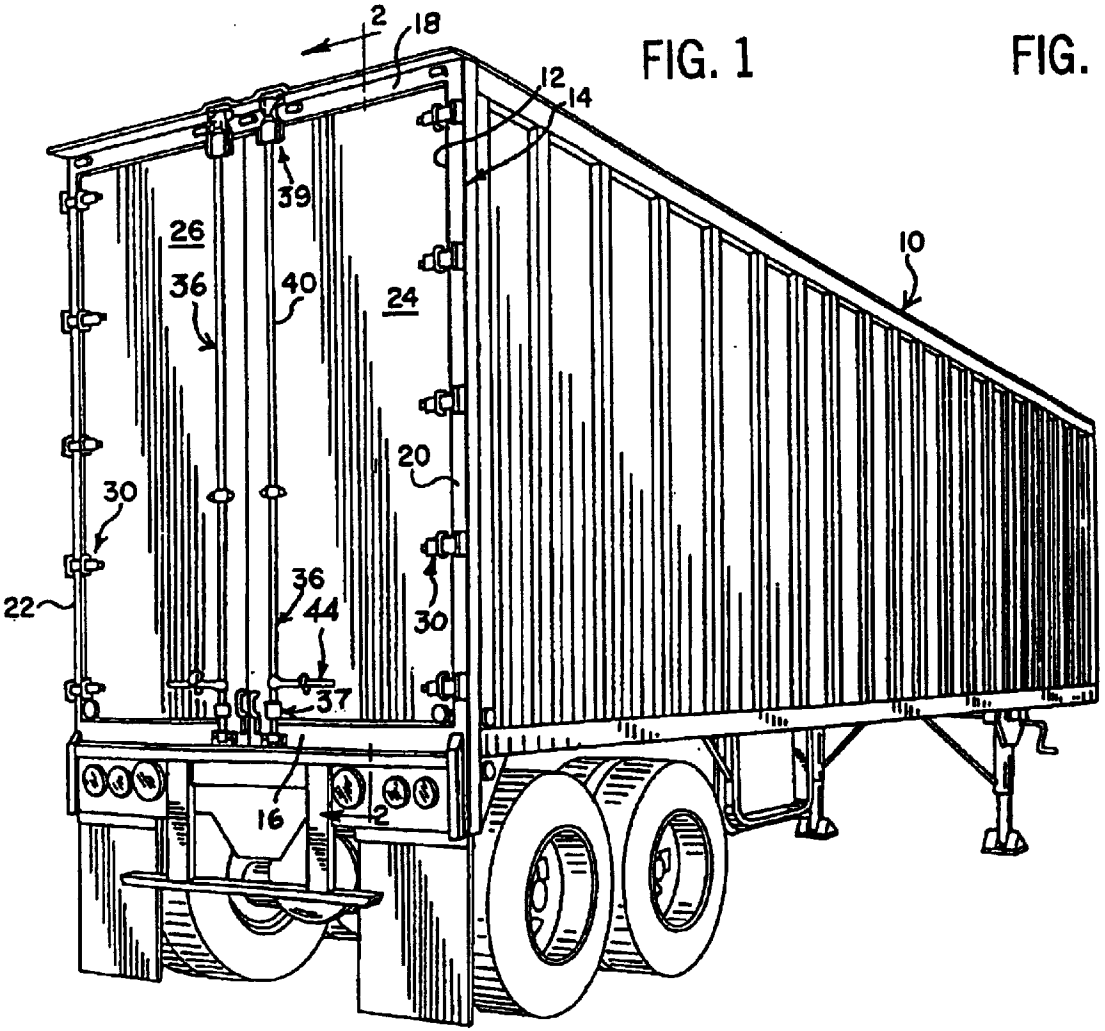
FIG. 1 is a perspective view of a cargo container which embodies a door control mechanism according to the present invention.

Referring now to the drawings, wherein like reference numerals indicate like parts through the several views, FIG. 1 illustrates a cargo container 10 having, at its rear end, a doorway opening 12. For exemplary purposes, the cargo container 10 is illustrated as a trailer truck body but it should be appreciated other forms of cargo containers are intended to be included within such phraseology as well. The doorway opening 12 is defined by a door frame 14 including a sill 16 transversely extending across a lower edge of the door frame and a header 18 transversely extending across an upper edge of the door frame. Side frame members 20 and 22 join the sill and header whereby adding strength and rigidity to the door frame 14. Disposed within the door frame 14 for closing same and adding further rigidity to the container 10 are a pair of doors 24 and 26. The doors 24, 26 are connected to frame members 20, 22 as by a series of hinges 30 which allow each door 24, 26 to swing within a plane defined by frame 14.

Turning to FIG. 2, to provide a suitable seal closure between the doors 24, 26 and the cargo container 10, resilient strip material 32 of suitable cross-sectional configuration is typically secured about the edges of the doors. As well known, the strip material 32 along one vertical edge of a door may be arranged to overlap the adjacent vertical edge of the other door.

The doors 24, 26 are adapted to be releasably maintained in their closed position relative to the frame 14 by a door control mechanism 36 provided on each door. Since the door control mechanisms 36 mounted on doors 24, 26 are mirror images of each other, the description of one door control mechanism, and the components associated therewith, will equally suffice as a description of the other door control mechanism.

As shown in FIG. 2, each door control mechanism 36 includes spaced latching and aligning mechanisms 37 and 39 arranged toward opposite ends of an operating shaft 40, and a handle mechanism 44 by which the operating shaft 40 may be manually rotated or turned.

Shaft 40 is adapted to be mounted generally parallel to an outer face of a cargo container door for rotation about a fixed axis. The operating shaft 40 is laterally spaced from the hinged edge of the door. In the illustrated embodiment, operating shaft 40 preferably has a tubular construction and is mounted to the respective door by a conventional attachment bracket 42 which limits axial movement of the operating shaft 40 in relation to the door to which the door control mechanism 36 is mounted. U.S. Pat. No. 4,068,409 to C. E. White better describes the bracket 42 for securing the door control mechanism 36 to the cargo door; with the applicable portions of U.S. Pat. No. 4,068,409 being incorporated herein by reference.

The handle mechanism 44 for each door control mechanism 30 can embody any suitable design. In the illustrated embodiment, handle mechanism 44 has a hand lever 45 preferably pivotally attached to operating shaft 40. The lever 45 for each mechanism 30 is normally retained in a locked position against the respective door by a suitable and conventional retainer.

In the illustrated embodiment, the latching and aligning mechanisms 37 and 39, while having certain similarities, have different configurations because of their locations relative to the door frame 14. Turning to FIG. 3, the latching and aligning mechanism 37 arranged toward one end of shaft 40 comprises a latching member 50 and a keeper member 52 which cooperate in an interengaging relationship to assist in aligning the respective door relative to the frame 14 and to releasably maintain the respective door in a closed position. Preferably, latching member 50 is arranged toward a lower end of and moves in response to rotation of the operating shaft 40 as through manual operation of handle mechanism 44 (FIG. 2). Keeper member 52 is secured as by welding or the like to the sill 16 of the door frame 14.

As is conventional, sill 16 of frame 14 is significantly wider than the header 18. As used herein and throughout, the term or phrases "wide" or "wider" or "width" are intended to indicate the vertical dimension of the particular component. As discussed below, the keeper member 52 for latching and aligning mechanism 37 can be and typically is designed with a significantly greater width than the keeper member for the other latching and aligning mechanism. Moreover, and because latching member 50 is connected toward a lower end of the operating shaft 40 and is adapted to cooperate with the keeper member 52, which is secured to the sill 16 of the door frame 14, it too is significantly greater in width than like components of mechanism 39.

Latching member 50 is preferably formed from steel and, as shown in FIG. 4, includes an elongated stem 60 defining an elongated axis 60' about which latching member 50 can rotate. In the illustrated embodiment, stem 60 is telescopically accommodated within one end of the hollow operating shaft 40 (FIG. 3) and is suitably secured thereto. Latching member 50 also includes a head portion 61 integrally connected to the stem 60 with a locking finger or tine 62 extending in a first lateral direction from one side of the head portion 61. Along substantially the entire length thereof, the locking finger or tine 62 has upper and lower slanting surfaces 63 and 64, respectively, which converge relative to each other and toward a distal end of the locking finger 62. Primarily because of the width of latching member 50 and its disposition toward a lower end of the operating shaft 40, the upper and lower slanting surfaces 63 and 64 can be tapered along substantially the entire length of the locking finger 62 without adversely affecting the overall strength and while increasing the gathering capability of latching member 50, as described in detail below. Moreover, and extending from the distal end inwardly toward the head portion 61, the locking finger or tine 62 is provided with a generally vertical flat surface 65.

In the embodiment illustrated in FIGS. 4 and 5, latching member 50 furthermore includes a heel portion 66 laterally extending from the head portion 61 in an direction opposite that direction locking tongue or tine 62 extends from the head portion 61. Heel portion 66 of latching member preferably includes upper and lower slanting faces 67 and 68, respectively, which are arranged in converging slanted relation relative to each other and which each converge toward a rear substantially linear abutment surface 69 of the latching member 50.

In the embodiment illustrated in FIGS. 3, 4 and 5, an annular collar 70 is preferably disposed between the stem 60 and the head portion 61 of the latching member 50. In the exemplary embodiment, collar 70 is configured to bear against the attachment bracket 42 in a manner aiding alignment of the respective door relative to the door frame 14. Of course, other suitable projections besides an annular collar would equally suffice for the intended purpose. It will be furthermore appreciated, latching member 50 can be otherwise designed and arranged in combination with alternative mounting structure to accomplish the same result without detracting or departing from the spirit and scope of the invention.

Turning to FIG. 6, keeper member 52 of the lower latching and aligning mechanism 37 includes a base 80 with first and second projecting portions 81 and 82, respectively, extending from opposite ends of base 80. As shown in FIGS. 3 and 6, the first projecting portion 81 includes a wall 83 spaced from the base 80 and having a generally vertical and flat inner surface 84. As shown, wall 83 is joined to the keeper member base 80 by wedge-like vertically spaced portions 85 and 86 (FIG. 3), preferably formed integral with the wall 83 and base 80. Each of the wedge like portions 85, 86 define a define generally horizontally disposed camming surface. Suffice it to say, base 80, wall 83, along with the upper and lower portions 85 and 86 serve in combination relative to each other to define a latch locking zone 89 for latching member 50.

Returning to FIG. 3, in the exemplary embodiment, the second projecting portion 82 on keeper member 52 comprises two vertically spaced fork-like projections 87 and 88. The projections 87 and 88 define between them a wedge-like opening 90 on the keeper member 52. As will be appreciated, the projections 87, 88 are configured to fit closely with but clear the upper and lower slanting surfaces 67 and 68, respectively, of the heel portion 66 of latching member 50.

Turning now to FIG. 7, the latching and aligning mechanism 39 at the other end of the operating shaft 40 comprises a latching member 150 and a keeper member 152. In operation, latching member 150 and keeper member 152 cooperate in an interengaging relationship and with the other latching and aligning mechanism 37 (FIG. 2) to assist in aligning the respective door relative to the frame 14 and to releasably maintain the respective door in a closed position.

After the door control mechanism 36 is mounted on the respective door, latching member 150 is preferably arranged toward an upper end of and moves in response to rotation of the operating shaft 40 as through manual operation of handle mechanism 44 (FIG. 2). Keeper member 152 is secured as by welding or the like preferably to the header 18 of the door frame 14.

As mentioned, and in an effort to maximize the capacity of the cargo container, the header 18 of frame 14 is significantly narrower than the sill. As such, the keeper member 152 for latching and aligning mechanism 39 is typically designed significantly narrower than the keeper member for the other latching and aligning mechanism. Moreover, and because latching member 150 is required to cooperate with the keeper member 152 and within the vertical space constraints defined by the narrow header 18, it too is significantly narrower than like components of the latching and aligning mechanism 37.

Latching member 150 is preferably formed from steel and, as shown in FIGS. 7 and 8, includes an elongated stem 160 which defines an elongated axis 160' about which the latching member 150 can rotate. In the illustrated embodiment, stem 160 is telescopically accommodated within one end of the hollow operating shaft 40 whereby aligning axes 60' of latching member 50 (FIG. 3) and 160' of latching member 150 relative to each other while furthermore causing latching members 50 and 150 to operably turn in unison relative to each other. Latching member 150 also includes a head portion 161 integrally connected to the stem 160 with a single locking finger or tine 162 extending in a first lateral direction from one side of the head portion 161.

One of the salient features of the present invention relates to the configuration of the latching member locking finger or tine 162. As shown in FIG. 8, the latching member locking finger or tine 162 has a relatively narrow width as compared to locking finger 50 of latching member 50 (FIG. 3). The width of the latching member locking finger or tine 162 is defined by spaced and generally parallel surfaces 163 and 164 extending along a major length of tine 162. As shown in FIG. 9, the latching member tine 162 is further configured with an outer convex surface 165 extending between surfaces 163, 164 and away from head portion 161 together with an inner concave surface 166 extending between surfaces 163, 164. In the preferred embodiment, the locking finger or tine 162 is configured such that the outer convex surface 165 and the inner concave surface 166 converge relative to each other and toward a distal end of the tine 162.

At a distal end thereof, the locking finger or tine 162 is configured with a horizontally tapered configuration to promote introduction of the locking finger 162 into a cooperating relationship relative to the respective keeper member 152. In general, the narrower and more tapered the tine 162, the better lead-in to the keeper member 152 during a door closing sequence and better the gather characteristics. There are, however, both manufacturing and strength problems associated with designing a taper for the distal end of the locking tine 162.

In one form, the tapered configuration at the distal end of the tine 162 involves designing the taper as a specific ratio. That is, distal end of the locking tine 162 is configured within a specific range. The range of the taper is such that for about every 0.1 inch of distance measured from the apex of the taper toward the head portion 161 of the latching member 150 there is between about 0.076 inch and about 0.119 inch of taper.

In another form, the tapered configuration at the distal end of the locking tine involves providing a slanting surface 167 angling away from either surface 163 or surface 164 and extending at an acute angle ranging between about 25° and about 60° relative to a generally horizontal plane. Additionally, the slanting surface 167 extends for a distance measuring between about 0.093 inches and about 0.500 inches from an apex of the tine 162 inwardly toward the head portion 161 of the latching member 150.

In the exemplary embodiment illustrated in FIG. 8, the taper at the distal end of the locking finger or tine 162 is configured with two generally planar slanted and converging surfaces 167 and 168 each angling toward the apex of the tine 162. Slanting surface 167 angles from surface 163 and extends toward the distal end of tine 162 while slanting surface 168 angles from surface 164 and extends toward the distal end of the tine 162. In a preferred form, each slanted surface 167, 168 is disposed at a generally equal angle relative to a generally horizontal plane. In the embodiment illustrated in FIG. 8, each slanted surface forms an acute angle of about 45° relative to a generally horizontal plane and extends inwardly toward the head portion 161 of latching member for a distance of about 0.200 inches.

As shown in FIG. 8, the single latching member locking finger or tine 162 is also provided with spaced and angularly diverging camming surfaces 173 and 174 whereby providing the locking finger or tine 162 with additional strength and rigidity. As shown in FIGS. 8 and 9, surface 173 angles away from surface 163 of the locking finger or tine 162 toward a top surface 175 of the head portion 161 of latching member 150. As shown, surface 174 angles away from surface 164 of the locking finger 162 and toward the head portion 161 of latching member 150.

In the embodiment shown in FIGS. 8, 9 and 10, latching member 150 also includes a heel portion 176 laterally extending from the head portion 161 in a direction opposite that direction locking tongue or tine 162 extends from the head portion 161. As shown in FIG. 10, heel portion 176 of latching member 150 preferably includes upper and lower slanting faces 177 and 178, respectively, which are arranged in converging slanted relation relative to each other and which each converge toward a rear substantially linear abutment surface 179 preferably arranged generally tangential to the convex surface 165 of the latching member 150.

In the embodiment illustrated in FIGS. 7, 8 and 9, an annular collar 180 is preferably disposed between the stem 160 and the head portion 161 of the latching member 150. Collar 180 is configured to bear against the attachment bracket 42 in manner aiding alignment of the respective door relative to the door frame 14. Of course, other suitable projections besides an annular collar would equally suffice for the intended purpose. It will be furthermore appreciated, latching member 150 can be otherwise designed and arranged in combination with alternative mounting structure to accomplish the same result without detracting or departing from the spirit and scope of the invention.

Returning to FIGS. 7 and 9, the keeper member 152 includes a base 190 with first and second projecting portions 191 and 192, respectively, extending from opposite ends of the base 190. Particularly as shown in FIG. 9, the first projecting portion 191 on keeper member 152 includes a vertically disposed and curved camming surface 193 having a generally convex profile which generally parallels the concave surface 166 of the locking finger or tine 162 of latching member 150. Surface 193 is rigidly and securely secured to the base 190 of keeper member 152 by a pair of spaced projections 194 and 195 (FIG. 7). Turning to FIG. 11, projection 194 preferably includes a camming or tapered surface 197 arranged along an undersurface of projection 194 arranged closest to the center of keeper member 152 and extending toward the terminal end thereof. Preferably, projection 195 also includes a camming or tapered surface 198 arranged along an undersurface of projection 195 arranged closest to the center of keeper member 152 and extending toward the terminal end thereof.

Returning to FIG. 7, when keeper member 152 is secured to the header 18 of the door frame, the camming surfaces 197 and 198 are generally horizontally disposed and are adapted to engage and coact with camming surfaces 173 and 174, respectively, on the locking tongue or tine 162 in aligning the respective door relative to the door frame 14. As shown in FIG. 9, base 190, the vertically disposed camming surface 193, along with the upper and lower projections 194 and 195 of keeper member 152 serve in combination relative to each other to define a latch locking zone 199 for latching member 150.

Returning to FIG. 11, in the exemplary embodiment, projecting portion 192 on keeper member 152 comprises two vertically spaced fork-like projections 181 and 182. The projections 181 and 182 define between them a wedge-like opening 184 on the keeper member 152. As will be appreciated, the projections 181, 182 are configured to fit closely with but clear the upper and lower slanting faces 177 and 188, respectively, of the heel portion 176 of latching member 152.

In closing the doors 24, 26, each door is first swung to a position generally in the plane of the door frame 14. The hand lever 45 is then pivoted from a forwardly extending position toward the respective door 24, 26 whereupon the operating shaft 40 is rotated, thus, causing the locking finger 62 on latching member 50 along with the locking finger or tine 162 on latching member 150 to approach the latch locking zones 89 sand 199 on the respective keeper members 50 and 152.

Figure 12:
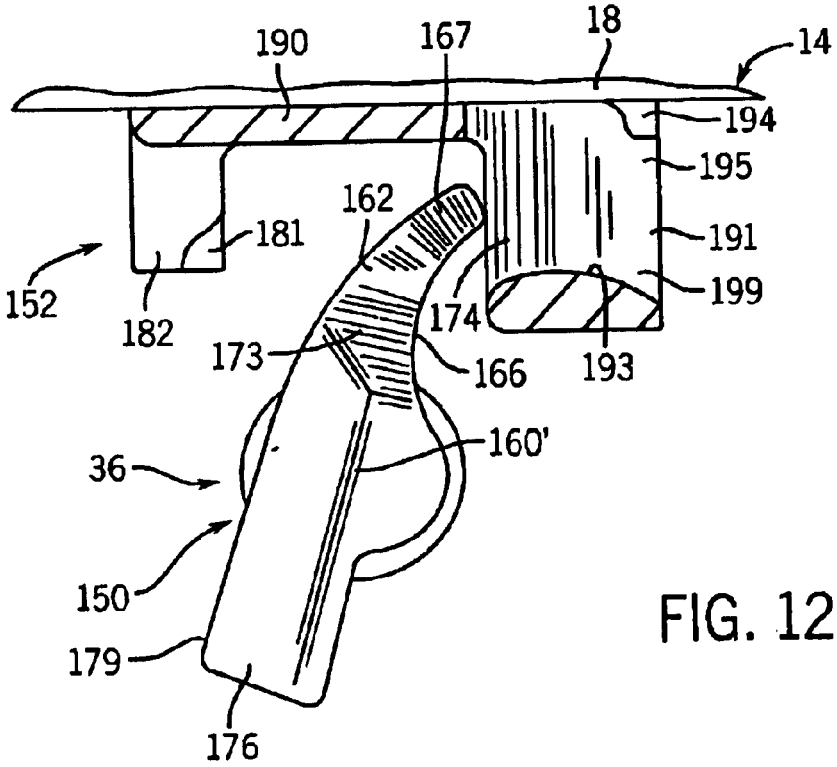
FIGS. 12 and 13 schematically represent the respective positions of different latching members arranged at opposed ends of the door control mechanism of the present invention as they move toward their respective keeper members.
Figure 13:
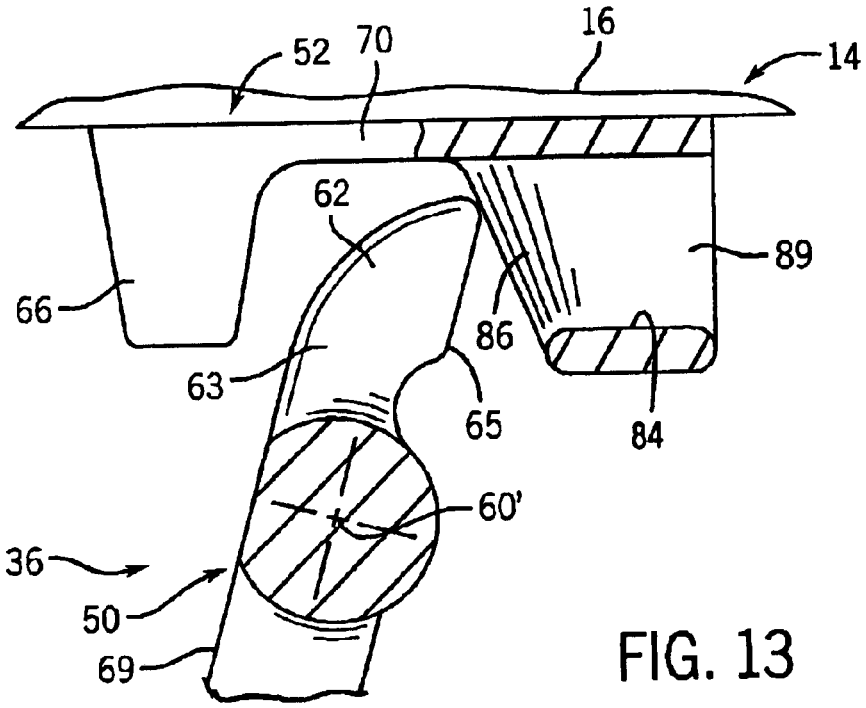

As illustrated in FIGS. 12 and 13, another salient feature of this invention relates to designing the tine or locking finger 62, 162 of each latching member 50, 150, respectively, such that the distal ends of the locking fingers 62, 162 are introduced to the latch locking zone 89, 199 of the respective keeper member 52, 152 in timed relation relative to each other. That is, each door control mechanism 36 is specifically designed such that the distal end of each tine or locking finger 62, 162 is introduced to the latch locking zone 89, 199 of the respective keeper member 52, 152 substantially simultaneously relative to each other. As will be appreciated by those skilled in the art, having the distal ends of the locking finger 62, 162 designed such that they reach the latch locking zone 89, 199 of the respective keeper member 52, 152 substantially simultaneously advantageously equals the gathering range of the locking members 50, 150 thereby allowing the door control mechanism 36 to take advantage of both latching and aligning mechanisms 37, 39 to align and, ultimately, close the doors 24, 26.

As the locking tongue 62 of latching member 50 passes through the latch locking zone 79 of keeper member 52, the slanted surfaces 63, 64 on latching member 50 (FIG. 4) cooperate with respective cam surfaces on the projections 85, 86 of keeper member 52 (FIG. 3) to vertically align the associated door relative to the door frame 14 and the flat surface 65 on the latching member 50 pushes against the vertical wall 83 on the keeper member 52 in a manner closing the door.

Simultaneously therewith, and as the locking tine 162 of latching member 150 passes through latch locking zone 99 of keeper member 152 the tapered configuration at the distal end of the locking finger 162 cooperates with either cam surface 197, 198 on the keeper member 152 to facilitate alignment of the door. As locking tine 162 passes through the locking zone 199 of keeper 152, the concave surface 166 cooperates with the generally vertical convex surface 193 on the first projection 191 of keeper member 152 in a manner moving the door toward a closed position. As the door moves to its closed position, the surfaces 173, 174 on the locking tine 162 cooperate with surfaces 197, 198 to further affect vertical alignment of the door relative to the door frame 14.

In the preferred embodiment, as the door moves toward its closed position, heel portion 66 of latching member 50 is introduced between the projections 87, 88 provided at the second end 82 of keeper member 52. As such, the slanting upper and lower surfaces 67, 68, respectively, on the heel portion 66 of the latching member 50 cooperate and coact with the cam surfaces 87, 88 on the keeper member 52 to further promote door alignment relative to the frame 14.

Additionally, and in a preferred embodiment, as the door moves toward its closed position, heel portion 176 of latching member 150 is introduced between the projections 181, 182 provided at the second end 192 of keeper member 152. As such, the slanting upper and lower surfaces 177, 178, respectively, on the heel portion 176 of the latching member 150 cooperate and coact with the cam surfaces 181, 182 on the keeper member 152 to further promote door alignment relative to the frame 14.

Continued rotation of the handle mechanism 44 causes the locking tines 62 and 162 to pass through the respective latch locking zones 89, 199 on the keepers 52, 152, respectively, until the abutment faces 69, 179 of the respective latching members 50, 150 contact the base 70, 190 of the respective keeper members 52, 152. In a most preferred form, the door control mechanism 36 is configured such that the abutment faces 69, 179 of the respective latching members 50, 150 contacts the base 70, 190 of the respective keeper members 52, 152 substantially simultaneously and as the door assumes its fully closed position. In the exemplary embodiment, when aligning and latching mechanism 37 has been operated to move the respective door into a fully closed position, and as illustrated in FIG. 9, the axis of rotation of the shaft 40 preferably passes an over-centering condition relative to the curved camming surface 193 of the associated keeper member 152 and lies closer to the door frame 14 than does the curved camming surface 193 on the respective keeper 152.

Advantageously, the latching member 150 is uniquely configured to facilitate introduction of the locking tine 162 into the locking zone 199 of the respective keeper member 152 notwithstanding the cargo container assuming a racked or misaligned condition. As mentioned, one of the salient features of latching member 150 relates to the tapered configuration at the distal end of the tine 162. As will be understood by those skilled in the art, and rather than merely abutting with the respective keeper member 152, as the locking tine 162 approaches the latch locking zone 199, the tapered configuration at the distal end of the tine 162 facilitates introduction of the tine 162 to the latch locking zone 199 to promote door closure rather than frustrating the operator in trying to forcibly overcome the abutting relationship of the tine relative to the respective keeper member. Of course, configuring the taper at the distal end of the locking tine as with two slanting surfaces 167, 168 promotes introduction of the tine 162 into the latch locking zone 199 regardless of the mannerism the cargo container is racked or swayed.

From the foregoing it will be readily appreciated and observed numerous modifications and variations can be effected without departing from the true spirit and scope of the novel concept of the present invention. It will be appreciated that the present disclosure is intended to set forth an exemplification of the present invention which is not intended to limit the invention to the specific embodiment illustrated. The disclosure is intended to cover by the appended claims all such modifications and colorful variations as fall within the spirt and scope of the claims.

What is claimed is:

1. A latching member for a door control mechanism adapted to be connected to a pivoting door and which is configured to coact with a keeper member, comprising:

a head portion provided at an end of a stem defining an elongated axis for and about which said latching member can rotate, a single, rigid tine formed integral with and extending from said head portion in a first lateral direction, and a heel portion formed integral with and extending from said head portion in a second lateral direction, with the tine of said latching member having spaced and generally parallel first and second surfaces extending along a middle portion of the tine, with an outer convex surface extending between said first and second surfaces and away from said head portion together with an inner concave surface extending between said first and second surfaces, and wherein a distal end of said tine has a tapered configuration in a region of the tine adapted to initially contact said keeper whereby promoting introduction of said tine into latching relation relative to said keeper, with the tapered configuration at the distal end of said tine, for about every 0.1 inch of distance measured from the apex of said taper toward said head portion, ranging about 0.076 inch to about 0.119 inch of taper, and wherein said tine is further configured with diverging slanted surfaces extending from said first and second surfaces and extending toward said head portion so as to add strength and rigidity to said tine.

2. The latching member according to claim 1, wherein said outer convex surface extends toward said distal end of said tine and is arranged in generally tangential relation relative to said head portion of said latching member.

3. The latching member according to claim 1, wherein the distal end of said tine is configured with two generally planar slanted and converging surfaces angling toward the apex of said tine, with each slanted surface being disposed at a generally equal angle relative to a generally horizontal plane.

4. A latching member for a door control mechanism used to latch closed a pivotal door of a cargo container, said latching member comprising:

a head portion integrally formed with and disposed at an end of an elongated stem defining a axis about which said latching member can rotate, a single, rigid tine formed integral with and extending from said head portion in a first lateral direction and having inner and outer curved surfaces, and a heel portion formed integral with and extending from said head portion in an opposite lateral direction, with said heel portion defining an abutment surface for limiting rotational movement of said latching member, and wherein said tine has upper and lower generally parallel surfaces extending along a middle portion of the length of said tine, and with a distal end of said tine being configured with at least one vertically slanted surface on a portion of the tine adapted to initially engage with a keeper, with said at least one slanted surface having a taper of about 0.02 inches to about 0.120 for every 0.1 inch of tine length as measured from an apex of said tine inwardly toward said head portion for promoting introduction of said latching member into cooperation with said keeper, and wherein said tine is further configured with diverging slanted surfaces extending from said upper and lower surfaces and extending toward said head portion for coacting with said keeper during the last few degrees of rotation of the latching member toward a closed position whereby facilitating alignment of said door relative to said cargo container.

5. The latching member according to claim 4, wherein the inner and outer curved surfaces of said tine converge relative to each other and toward the distal end of said tine.

6. The latching member according to claim 4, wherein said heel portion has upper and lower faces which converge toward said abutment surface.

7. The latching member according to claim 4, wherein the distal end of said tine is configured with two generally planar vertically slanted and converging surfaces angling toward the apex of said tine, with each slanted surface being disposed at a generally equal angle relative to a generally horizontal plane.

8. The latching member according to claim 7, wherein each generally planar slanting surface at the distal end of said tine forms an angle of about 45° relative to said generally horizontal plane and extends inwardly toward the head portion for a distance of about 0.200 inches.

9. A door control mechanism for a door hinged to a door frame of a cargo container, said door frame including a header and a sill interconnected through a pair of side frame members, said door control mechanism comprising:

an operating shall adapted to be rotatably mounted generally parallel to an outer face of said door about a substantially fixed vertical axis spaced from a hinged edge of the door;

first and second latching members arranged toward opposite ends of and secured for rotation with said operating shall, with said latching members being configured such that one latching member has significantly greater gather than the other latching member, and wherein each latching member comprises a locking tine extending in a first lateral direction from a head portion of the latching member and a heel portion extending in an opposite lateral direction from said head portion of the latching member, and wherein the tine of at least one latching member is configured with inner and outer curved surfaces which converge relative to each other and toward a distal end of said tine and which extend between upper and lower generally parallel surfaces extending along a middle portion of said tine, with the distal end of said tine of said at least one latching member being configured with at least one slanting surface leading from the distal end of said tine for a distance ranging about 0.093 inches to about 0.500 inches, and wherein said tine of said least one latching member is further configured with diverging slanted surfaces extending from said upper and lower surfaces and extending toward said head portion so as to add strength and rigidity to said tine; and first and second keeper members configured to cooperate with said latching members in a manner promoting alignment and positioning of said door as a function of the rotation of said shaft, with each keeper member including a base having first and second projecting portions arranged toward opposed ends of said base, with the first projecting portion of each keeper member defining a latch locking zone with a wedge-like stem portion defining a cam surface configured to cam the tine of a respective latching member into said locking zone when said mechanism is operated to move said latching members into cooperative locking relation relative to their respective keeper members, and with the second projecting portion being configured to releasably accommodate the heel portion of a respective latching member therebetween in a manner facilitating alignment of the door relative to the door frame, and wherein the cam surface on one keeper members is specifically configured to cooperate with that latching member having greater gather whereby facilitating alignment of the door relative to the door frame, and wherein both latching members are configured and secured to said operating shaft such that either the latching member having the greater gather engages with its respective keeper member before the other latching member engages its respective keeper member or the distal end of the tine on each locking member is introduced into the latch locking zone of the respective keeper members substantially simultaneously thereby offering an improved gathering range when said mechanism is operated to position said latching members in locking relation relative to their respective keeper members.

10. The door control mechanism according to claim 9, wherein the one latching member having significantly greater gather than the other latching member is disposed to cooperate with a keeper member adapted to be secured to the sill of said door frame.

11. The door control mechanism according to claim 9, wherein each latching member further includes a collar at a lower end of said head portion.

12. The door control mechanism according to claim 9, wherein the tine of said at least one of said locking members is configured with two generally planar slanted and converging surfaces extending from said parallel surfaces and angling toward an apex of said tine, with each slanted surface being disposed at a generally equal angle relative to a generally horizontal plane to facilitate introduction of said latching member into the locking zone of a respective keeper member.

13. The door control mechanism according to claim 12, wherein said slanting surfaces at the distal end of said tine extend at an acute angle ranging between about 25° and about 60° for a distance measuring between about 0.093 inches and about 0.500 inches from an apex of said tine inwardly toward said head portion.

14. The door control mechanism according to claim 9, wherein at least one of said keeper members includes a second wedge-like stem portion defining a second cam surface arranged in vertically spaced relation relative to said cam surface and configured to cam the tine of a respective latching member into said latch locking zone.

* * * * *